US012264478B1

(12) United States Patent
Rieffenberger

(10) Patent No.: US 12,264,478 B1
(45) Date of Patent: Apr. 1, 2025

(54) BALUSTER STABILIZER

(71) Applicant: William A. Rieffenberger, Watertown, SD (US)

(72) Inventor: William A. Rieffenberger, Watertown, SD (US)

( * ) Notice: Subject to any disclaimer, the term of this patent is extended or adjusted under 35 U.S.C. 154(b) by 144 days.

(21) Appl. No.: 17/931,191

(22) Filed: Sep. 12, 2022

Related U.S. Application Data

(60) Provisional application No. 63/261,231, filed on Sep. 15, 2021.

(51) Int. Cl.
*E04F 11/18* (2006.01)

(52) U.S. Cl.
CPC ..... *E04F 11/1846* (2013.01)

(58) Field of Classification Search
CPC . E04F 11/1846; E04F 11/181; E04F 11/1812; E04F 11/1836; E04F 2011/1821
See application file for complete search history.

(56) References Cited

U.S. PATENT DOCUMENTS 281,077 A * 7/1883 Jones ..... E04H 17/1413 256/65.03
2,735,702 A * 2/1956 Larson ..... A47B 3/0818 108/125
2,904,314 A * 9/1959 Thom ..... F16B 7/0493 403/345
4,743,152 A * 5/1988 Nakayama ..... F16B 37/043 411/182
5,150,885 A * 9/1992 Leone ..... E04H 17/1439 256/22
5,193,961 A * 3/1993 Hoyle ..... F16B 21/075 24/297
5,718,549 A * 2/1998 Noda ..... F16B 5/0657 411/553
6,311,957 B1 * 11/2001 Driscoll ..... E04F 11/1853 256/65.05
6,341,764 B1 * 1/2002 Conner ..... E04H 17/1439 256/19
6,481,697 B1 * 11/2002 Brown ..... E04F 11/1834 256/64
7,082,735 B2 * 8/2006 Ramsey ..... E04F 11/1842 52/832
7,243,450 B2 * 7/2007 Dicke ..... G09F 15/0056 40/607.1
7,475,870 B2 * 1/2009 Platt ..... E04F 11/1834 256/60
9,234,368 B2 * 1/2016 Zhu ..... F16B 7/0446
(Continued)

*Primary Examiner* — Paola Agudelo
(74) *Attorney, Agent, or Firm* — Sherrill Law Offices, PLLC

(57) ABSTRACT

A baluster stabilizer and method of installing a stabilized baluster between a floor and a rail. The stabilizer includes a planar base and a transverse projection(s). The base has a transverse primary opening therethrough configured and arranged for press fit insertion of an end of a baluster therethrough. The projection(s) extend in a first transverse direction from the lower major surface of the base proximate each of at least three sides of the primary opening for extension into a drilled hole into which the end of the baluster is to be inserted. The projection(s) are configured to allow unimpeded insertion of an end of a baluster from the upper major surface through the primary orifice and past the projections.

11 Claims, 7 Drawing Sheets

(56) References Cited

U.S. PATENT DOCUMENTS

| | | | | |
|---|---|---|---|---|
| D783,385 | S * | 4/2017 | Zhu | D8/394 |
| 11,851,905 | B2 * | 12/2023 | Niederkofler | E04H 17/1456 |
| 2001/0026728 | A1 * | 10/2001 | Green | F16B 2/22 403/317 |
| 2009/0173926 | A1 * | 7/2009 | Timothy | E04F 11/181 256/65.02 |
| 2015/0115214 | A1 * | 4/2015 | Schneider | E04F 11/1844 256/67 |
| 2016/0145873 | A1 * | 5/2016 | Green | E04F 11/1814 52/832 |
| 2022/0127811 | A1 * | 4/2022 | Nill | E04B 1/4121 |
| 2022/0243477 | A1 * | 8/2022 | Barnds | E04F 11/1817 |
| 2022/0307267 | A1 * | 9/2022 | Townsend | E04F 11/1846 |
| 2023/0003031 | A1 * | 1/2023 | Leary | E04F 11/1812 |

* cited by examiner

BALUSTER STABILIZER

BACKGROUND

Baluster, particularly metal balusters, tend to be unsteady and wobble due to lack of a tight fit of the baluster ends into the holes drilled into the floor and rail. This unsteady wobbling gives the railing an imperfect look and feel.

Hence, a substantial need exists for a device and/or baluster installation technique that provides a close-fitting fixed attachment of balusters to the floor and rail into which the balusters are inserted.

SUMMARY OF THE INVENTION

A first aspect of the invention is a baluster stabilizer. The stabilizer includes a longitudinally and laterally extending planar base and a transverse projection. The base has (i) transversely spaced upper and lower major surfaces, (ii) a transverse primary opening therethrough configured and arranged for press fit insertion of an end of a baluster therethrough, and (iii) at least one transverse orifice for accommodating passage of a mechanical fastener. The projections extend in a first transverse direction from the lower major surface of the base proximate each of at least three sides of the primary opening. The projections are configured and arranged for (i) extension into a drilled hole into which the end of the baluster is to be inserted, and (ii) unimpeded insertion of an end of a baluster from the upper major surface through the primary orifice and past the projections.

A second aspect of the invention is method of installing a baluster between a floor and a rail. The method includes the steps, in any desired achievable order, of (-) obtaining an axially elongated baluster having a proximal axial end and a distal axial end, (-) obtaining a first stabilizer and a second stabilizer, each comprising (A) a planar base having (i) transversely spaced upper and lower major surfaces, (ii) a transverse primary opening therethrough configured and arranged for press fit insertion of an end of a baluster therethrough, and (iii) at least one transverse orifice for accommodating passage of a fastening screw, and (B) a projection extending in a first transverse direction from the lower major surface proximate each of at least three sides of the primary opening, the projections configured and arranged for (i) extension into a hole into which an end of the baluster is to be inserted, and (ii) unimpeded insertion of the end of the baluster from the upper major surface through the primary orifice and past the projections, (-) placing the first stabilizer into position over a hole extending into the floor from an upper surface of the floor, with the lower major surface of the first stabilizer facing the floor and the projections on the first stabilizer extending into the hole in the floor to form a positioned first stabilizer, (-) fastening the positioned first stabilizer to the floor to form a fastened first stabilizer, (-) placing the second stabilizer into position over a hole extending into the rail from a lower surface of the rail, with the lower major surface of the second stabilizer facing the rail and the projections on the second stabilizer extending into the hole in the rail to form a positioned second stabilizer, (-) fastening the positioned second stabilizer to the rail to form a fastened second stabilizer, (-) axially inserting the baluster into the transverse primary opening through the first stabilizer, (-) axially inserting the baluster into the transverse primary opening through the second stabilizer, (-) axially inserting the proximal end of the baluster into the hole extending into the floor, and (-) axially inserting the distal end of the baluster into the hole extending into the rail.

Optionally but preferably, the method includes the additional steps, in any desired achievable order, of (-) obtaining a pair of baluster shoes, (-) axially sliding the baluster shoes onto the baluster before completing axial insertion of the baluster into the transverse primary opening through both of the stabilizers, (-) axially sliding one baluster shoe along the baluster into position to conceal the fastened first stabilizer, and (-) axially sliding the other baluster shoe along the baluster into position to conceal the fastened second stabilizer.

DETAILED DESCRIPTION OF THE INVENTION INCLUDING A PREFERRED EMBODIMENT

Nomenclature Table

Figure 1:
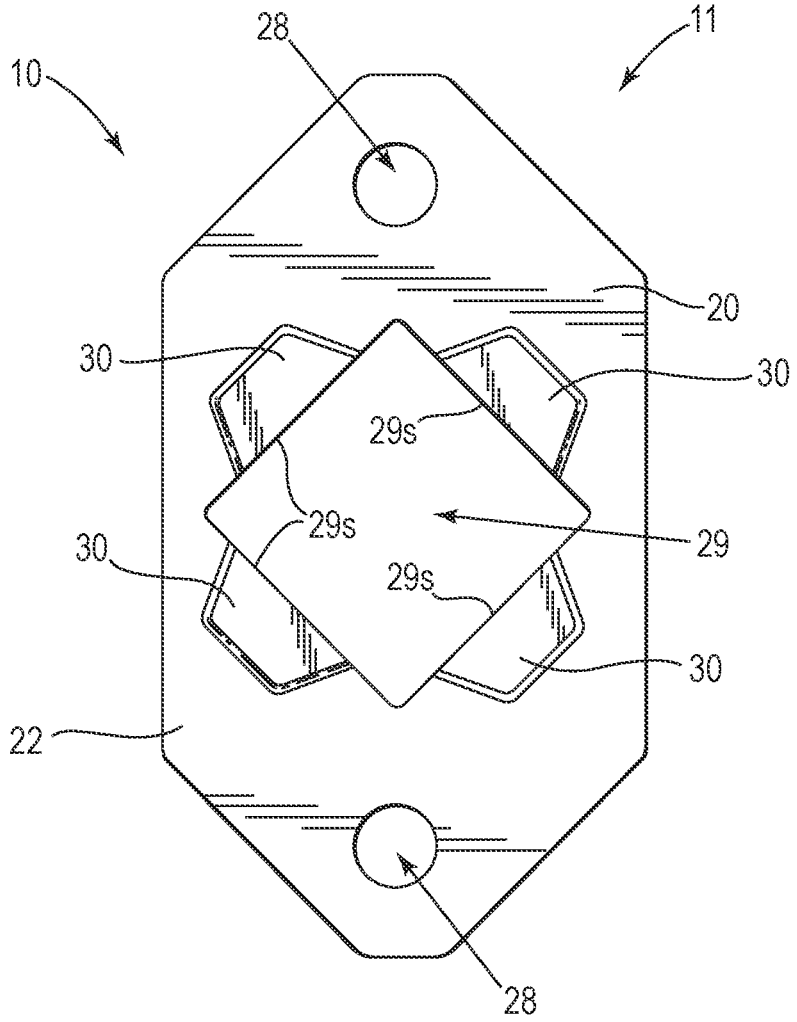
FIG. 1 is a bottom view of one embodiment of an orthogonal mounted baluster stabilizer in accordance with the invention.

| REF. NO. | DESCRIPTION |
|---|---|
| 10 | Stabilizer |
| 11 | Orthogonal 90° Mounted Baluster Stabilizer |
| 12 | 45° Angle Mounted Baluster Stabilizer |
| 20 | Base |
| 21 | Upper Major Surface |
| 22 | Lower Major Surface |
| 28 | Orifice for Fastener |
| 29 | Transverse Primary Opening |
| 29s | Sides of Transverse Primary Opening |
| 30 | Projection |
| B | Baluster |
| $B_1$ | Proximal Axial End of Baluster |
| $B_2$ | Distal Axial End of Baluster |
| BS | Baluster Shoe |
| F | Fastening Screw |
| H | Drilled Baluster Retention Hole |
| R | Rail |
| S | Stair Tread or Floor |
| T | Transverse Axis |
| $T_1$ | First Transverse Direction |

Construction

Referring to FIGS. 1-5, the baluster stabilizer 10 includes a planar base 20 and a projection(s) 30 extending in a first transverse $T_1$ direction from the planar base 20.

The base 20 has transversely T spaced upper 21 and lower 22 major surfaces with a transverse T primary opening 29 extending therethrough. The primary opening 29 is configured and arranged for press fit insertion of an end of a baluster B, typically a metal baluster B, therethrough. At least one transverse T orifice 28 is provided through the base 20 for accommodating passage of a fastener F, typically a screw.

A projection or set of projections 30 extend in a first transverse $T_1$ direction from the lower major surface 22. The projection(s) 30 extend proximate each of at least three sides 29*s* of the primary opening 29. The projections 30 are configured and arranged for extension into a drilled hole H into which the end of the baluster B is to be inserted, and providing unimpeded insertion of an end of a baluster B from the upper major surface 21 through the primary opening 29 and past the projection(s) 30.

Figure 2:
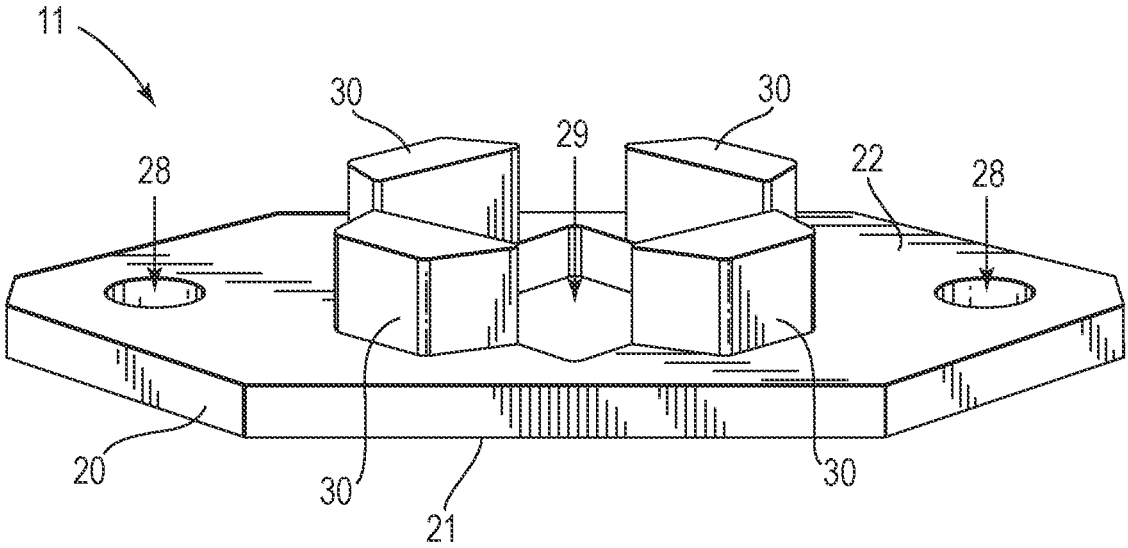
FIG. 2 is a perspective side view of the baluster stabilizer depicted in FIG. 1.
Figure 3:
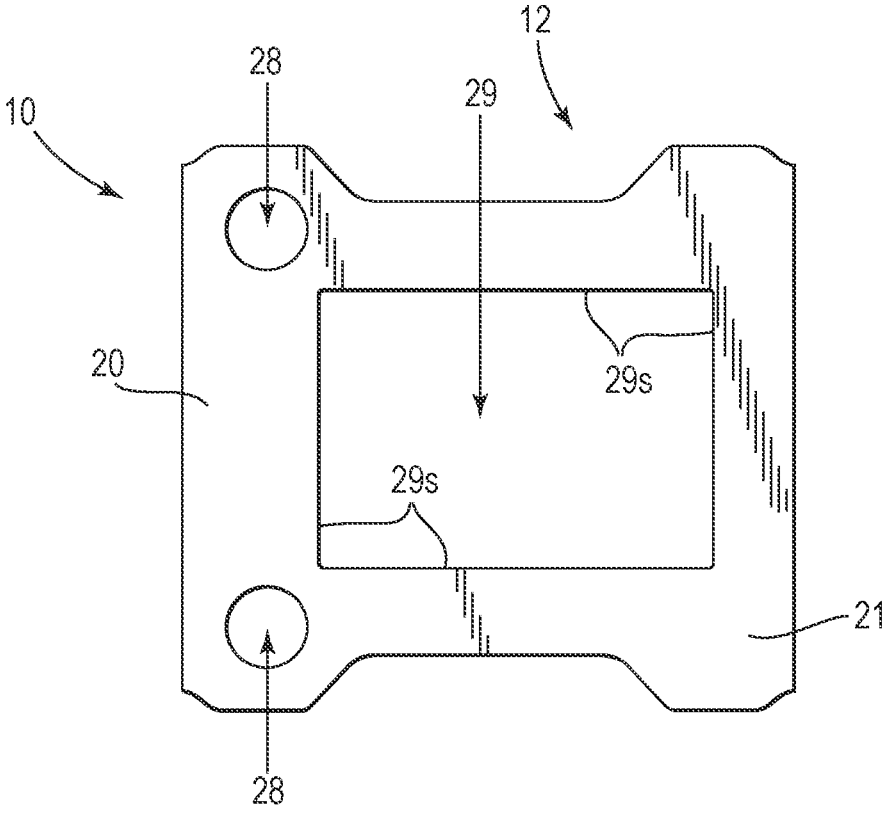
FIG. 3 is a top view of one embodiment of an angle mounted baluster stabilizer in accordance with the invention.
Figure 4:
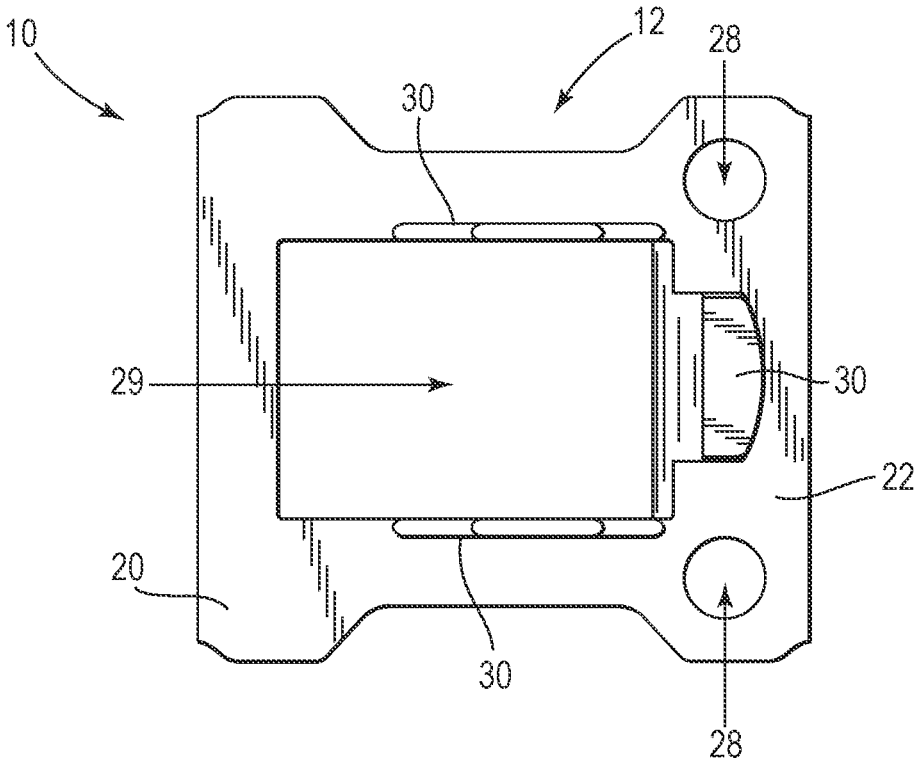
FIG. 4 is bottom view of the baluster stabilizer depicted in FIG. 3.
Figure 5:
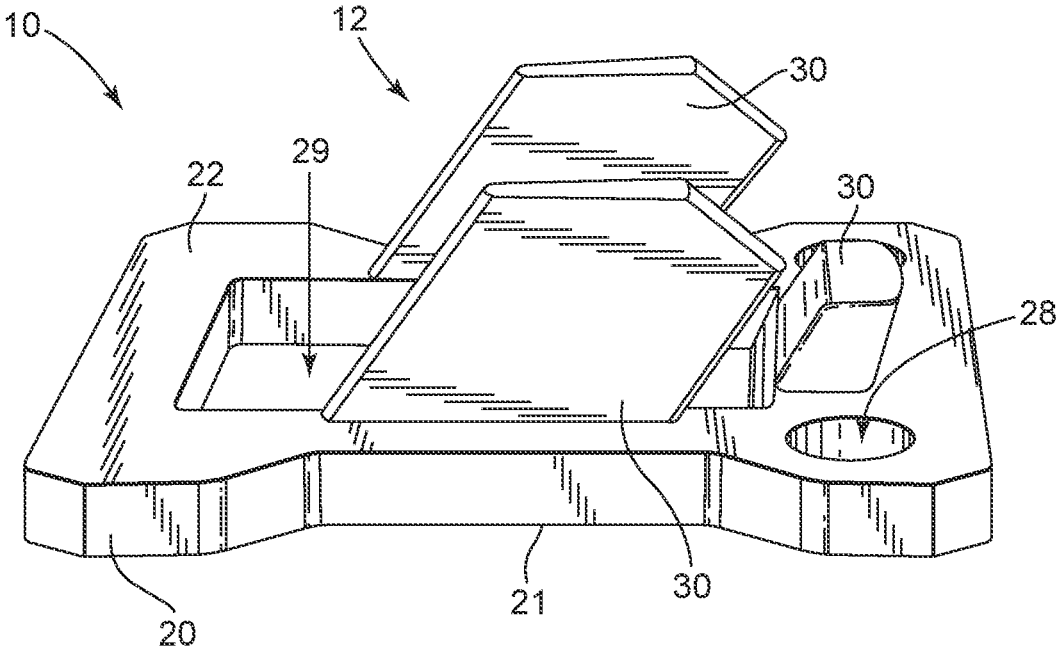
FIG. 5 is a perspective side view of the baluster stabilizer depicted in FIG. 3.
Figure 6:
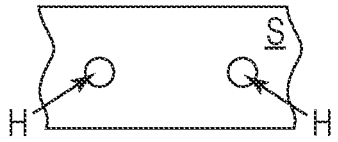
FIG. 6 is a top view of a floor board with a pair of laterally spaced holes drilled into the floor board from an upper surface of the floor board.

The baluster stabilizer 10 can be configured and arranged as either (i) an orthogonal mounted baluster stabilizer 11 as depicted in FIGS. 1 and 2 for use when attaching a baluster B to a rail, stair tread, floor or other board R or S when the baluster B extends orthogonal to the rail, stair tread, floor or other board R or S, or (ii) an angle mounted baluster stabilizer 12 as depicted in FIGS. 3-5 for use when attaching a baluster B to a rail, stair tread, floor or other board R or S when the baluster B extends at an acute angle (e.g., 45°) to the rail, stair tread, floor or other board R or S.

Referring to FIGS. 2 and 5, in order to prevent the projections 30 from impeding passage of an axial end $B_1$ or $B_2$ of a baluster B through the primary opening 29 in the base 20 and into the retention hole H drilled into the rail R or the stair tread or floor S, the projections 30 on an orthogonal mounted baluster stabilizer 11 do not extend into a transverse T orthogonal extension of the primary opening 29, while the projections 30 on an angle mounted baluster stabilizer 12 do not extend into an angled transverse T extension of the primary opening 29 with the angle of extension matching the angle at which the baluster B will extend from the board R or S.

The projections preferably transversely T extend about $\frac{1}{8}^{th}$ to $\frac{1}{4}^{th}$ of an inch from the lower major surface 22 of the base 20. A distance of less than about $\frac{1}{8}^{th}$ of an inch may provide insufficient lateral and longitudinal stabilization of the stabilizer 10 within the baluster retention hole H while a distance of greater than about $\frac{1}{4}^{th}$ of an inch may cause the distal ends of the projections 30 to strike the closed end of the baluster retention hole H and prevent the base 20 from resting flush upon the rail, stair tread, floor or other board R or S.

The baluster stabilizer 10 can be constructed from any material possessing the necessary structural integrity for stably supporting connection of a baluster B to rail, stair tread, floor or other board R or S, including specifically but not exclusive metal such as aluminum or steel, or plastic such as high-density polyethylene (HDPE) or rigid polyvinyl chloride (PVC).

Method of Using to Install a Stabilized Baluster

Referring to FIGS. 6-15, the baluster stabilizer 10 can be used during installation of a baluster B to stabilize connection of one end of the baluster B to a rail R and connection of the other end to a stair tread, floor or other board S.

Figure 14:
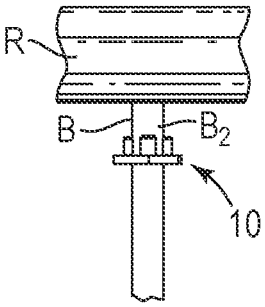
FIG. 14 is a side view of the fully prepared baluster of FIG. 13 with a second axial end of the baluster inserted the one of the holes in the rails depicted in FIG. 11.
Figure 15:
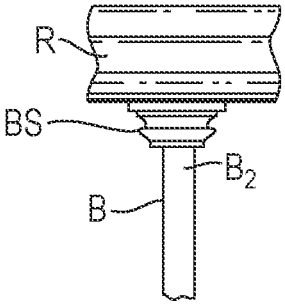
FIG. 15 is a side view of the inserted fully prepared baluster of FIG. 14 with the second baluster stabilizer slid along the baluster into position over the hole in the rail with the projections on the second baluster stabilizer projecting into the hole, the positioned second baluster stabilizer fastened to the rail with a pair of screws, and the another baluster shoe slid along the baluster into position over the fastened second baluster stabilizer so as to conceal the fastened second baluster stabilizer.

Installation of a stabilized baluster B in accordance with the invention includes the steps, in any desired achievable order, of (-) obtaining an axially elongated baluster B having a proximal axial end $B_1$ and a distal axial end $B_2$, (-) obtaining a pair of stabilizers 10, (-) placing one of the stabilizers 10 into position over a hole H extending into the stair tread or floor S from an upper surface of the stair tread or floor S with the lower major surface 22 of the stabilizer 10 facing the stair tread or floor S and the projection(s) 30 extending into the hole H in the stair tread or floor S to form a positioned first stabilizer 10 (FIGS. 7A and 7B), (-) fastening the positioned first stabilizer 10 to the stair tread or floor S to form a fastened first stabilizer 10 (FIG. 8), (-) placing the other stabilizer 10 into position over a hole H extending into the rail R from a lower surface of the rail R, with the lower major surface 22 of the stabilizer 10 facing the rail R and the projection(s) 30 extending into the hole H in the rail R to form a positioned second stabilizer 10 (FIG. 15), (-) fastening the positioned second stabilizer 10 to the rail R to form a fastened second stabilizer 10 (FIG. 15), (-) axially inserting the baluster B into the transverse primary opening 29 through the first stabilizer 10 (FIG. 14), (-) axially inserting the baluster B into the transverse primary opening 29 through the second stabilizer 10 (FIG. 13), (-) axially inserting the proximal end $B_1$ of the baluster B into the hole H extending into the stair tread or floor S (FIG. 9), and (-) axially inserting the distal end $B_2$ of the baluster B into the hole H extending into the rail R (FIG. 14).

Optionally but preferably, the method includes the additional steps of (-) obtaining a pair of baluster shoes BS, (-) axially sliding the baluster shoes BS onto the baluster B before completing axial insertion of the baluster B into the transverse primary openings 29 in both of the stabilizers 10, (-) axially sliding one of the baluster shoes BS along the baluster B into position to conceal one of the fastened baluster stabilizers 10, and (-) axially sliding the other baluster shoe BS along the baluster B into position to conceal the other fastened baluster stabilizer 10.

A preferred sequence for installing a stabilized baluster B in accordance with the invention includes the ordered steps of (-) placing a first of the stabilizers 10 into position over a hole H extending into the stair tread or floor S from an upper surface of the stair tread or floor S with the lower major surface 22 of the stabilizer 10 facing the stair tread or floor S and the projection(s) 30 extending into the hole H in the stair tread or floor S to form a positioned first stabilizer 10, (-) fastening the positioned first stabilizer 10 to the stair tread or floor S to form a fastened first stabilizer 10, (-) axially inserting the proximal axial end $B_1$ of the baluster B into the transverse primary opening 29 through the fastened first stabilizer 10 followed by continued insertion of the proximal axial end $B_1$ of the baluster B until it extends into the hole H in the stair tread or floor S covered by the fastened first stabilizer 10, (-) axially inserting the distal axial end $B_2$ of the baluster B into the transverse primary opening 29 through a second of the stabilizers 10, (-) axially inserting of the distal end $B_2$ of the baluster B into the hole H in the rail R, (-) sliding the second stabilizer 10 along the baluster B into position over the hole H in the rail R with the lower major surface 22 of the second stabilizer 10 facing the rail R and the projection(s) 30 extending into the hole H in the rail R to form a positioned second stabilizer 10, and (-) fastening the positioned second stabilizer 10 to the rail R to form a fastened second stabilizer 10.

Figure 7A:
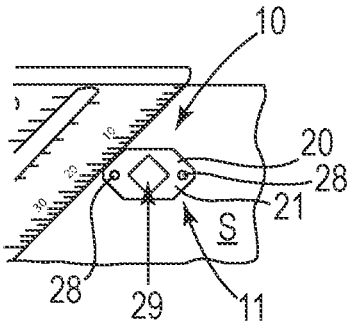
FIG. 7A is a top view of a first baluster stabilizer depicted in FIG. 1 placed into position with the primary opening through the first baluster stabilizer at a 45° angle over one of the holes in the floor board depicted in FIG. 6 with the projections on the first baluster stabilizer projecting into the hole.
Figure 7B:
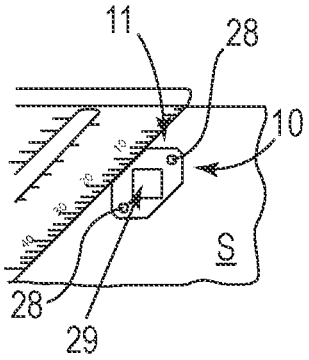
FIG. 7B is a top view of a first baluster stabilizer depicted in FIG. 1 placed into position with the primary opening through the first baluster stabilizer at a 90° angle over one of the holes in the floor board depicted in FIG. 6 with the projections on the first baluster stabilizer projecting into the hole.
Figure 8:
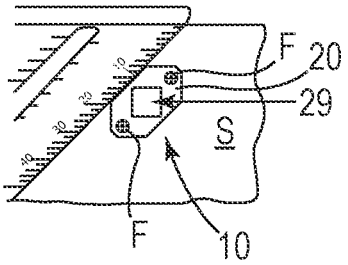
FIG. 8 is a top view of the positioned first baluster stabilizer depicted in FIG. 7A fastened to the floor board with a pair of screws.
Figure 9:
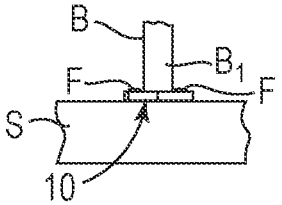
FIG. 9 is a side view of the fastened baluster stabilizer depicted in FIG. 8 with a first axial end of a baluster inserted into the transverse primary opening through the fastened first baluster stabilizer and into the hole in the floor board to form a first end stabilized baluster.
Figure 10:
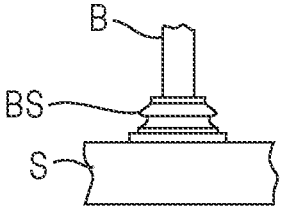
FIG. 10 is a side view of the first end stabilized baluster depicted in FIG. 9 with a baluster shoe axially slid along the first end stabilized baluster so as to conceal the fastened first baluster stabilizer.
Figure 11:
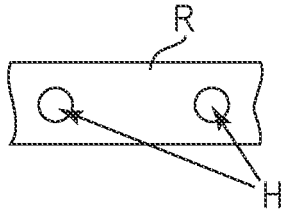
FIG. 11 is a bottom view of a rail with a pair of laterally spaced holes drilled into the rail from a lower surface of the rail.
Figure 12:
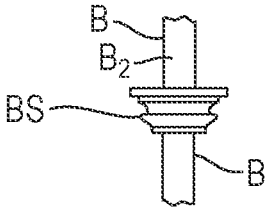
FIG. 12 is a side view of another baluster shoe slid onto the first end stabilized baluster depicted in FIG. 9 to form a partially prepared baluster.
Figure 13:
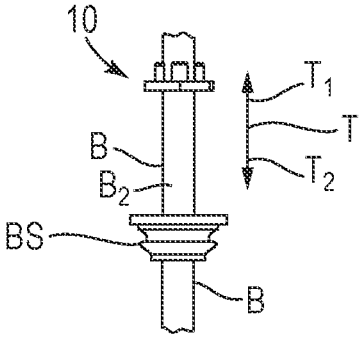
FIG. 13 is a side view of a second baluster stabilizer slid onto the partially prepared baluster depicted in FIG. 12 with the projections on the second baluster stabilizer extending towards the second axial end of the baluster to form a fully prepared baluster.

As depicted in FIGS. 7A and 7B, the stabilizer 10 can be fastened to the stair tread, floor or rail S or R at any desired axially rotation to provide different visually appearances to the installed baluster B (e.g., 90° squared or 45° angled diamond pattern relative to the line of a linear set of installed balusters B when the baluster B has a square cross-section). Referring to FIGS. 1, 7A and 7B, the base 20 on the stabilizer 10 can have a peripheral shape that provides at least one side and preferably at least two opposing sides (unnumbered) that parallel the sides 29*s* of the transverse opening 29 through the stabilizer 10, and at least one side and preferably at least two opposing sides (unnumbered) that extend at a 45° angled relative to the sides 29*s* of the transverse opening 29 through the stabilizer 10 to facilitate axial orientation of the stabilizers 10 on a stair tread, floor or rail S or R as between a 90° squared mount 11 and a 45° angled mount 12 using a speed square.

I claim:

1. A single piece baluster stabilizer comprising:

(a) a laterally and longitudinally extending planar base having (i) transversely spaced upper and lower major surfaces, (ii) a transverse primary opening therethrough configured and arranged for press fit insertion of an end of a baluster completely therethrough, and (iii) at least one transverse orifice for accommodating passage of a fastening screw, and (b) a projection extending in a first transverse direction from the lower major surface proximate each of at least three sides of the primary opening, the projections configured and arranged for (i) extension into a round hole drilled into a supporting structure into which the end of the baluster is to be inserted thereby forming inserted projections, (ii) fitted engagement within the round hole for stabilizing the lateral and longitudinal position of the baluster stabilizer relative to the round hole, and (iii) unimpeded insertion of the end of the baluster from the upper major surface through the primary opening, past the inserted projections, and into the round hole.

2. The baluster stabilizer of claim 1 wherein the projections are configured and arranged for unimpeded insertion of an end of a baluster from the upper major surface through the primary opening and past the projections at a 90° angle relative to the planar base.

3. The baluster stabilizer of claim 2 wherein the primary opening is a square.

4. The baluster stabilizer of claim 1 wherein the projections are configured and arranged for unimpeded insertion of an end of a baluster from the upper major surface through the primary opening and past the projections at an acute angle relative to the planar base.

5. The baluster stabilizer of claim 4 wherein the acute angle is 45°.

6. The baluster stabilizer of claim 4 wherein the primary opening is a rectangle.

7. The baluster stabilizer of claim 1 sized, configured and arranged for concealment by a baluster shoe.

8. The baluster stabilizer of claim 1 sized, configured and arranged for concealment within a void cavity of a hollow baluster shoe.

9. A method of installing a baluster between a floor and a rail, comprising the steps of:

(a) obtaining an axially elongated baluster having a proximal axial end and a distal axial end, (b) obtaining a first single piece stabilizer and a second single piece stabilizer, each comprising:

(1) a laterally and longitudinally extending planar base having (i) transversely spaced upper and lower major surfaces, (ii) a transverse primary opening therethrough configured and arranged for press fit insertion of an end of a baluster completely therethrough, and (iii) at least one transverse orifice for accommodating passage of a fastening screw, and (2) a projection extending in a first transverse direction from the lower major surface proximate each of at least three sides of the primary opening, the projections configured and arranged for (i) extension into a round hole drilled into a supporting structure into which an end of the baluster is to be inserted, (ii) fitted engagement within the round hole for stabilizing the lateral and longitudinal position of the baluster stabilizer relative to the round hole, and (iii) unimpeded insertion of the end of the baluster from the upper major surface through the primary orifice and past the projections, and into the round hole, (c) placing the first stabilizer into position over a round hole extending into the floor from an upper surface of the floor, with the lower major surface of the first stabilizer facing the floor and the projections on the first stabilizer extending into the round hole in the floor to form a laterally and longitudinally positionally stabilized first stabilizer, (d) fastening the positioned first stabilizer to the floor to form a fastened first stabilizer, (e) placing the second stabilizer into position over a round hole extending into the rail from a lower surface of the rail, with the lower major surface of the second stabilizer facing the rail and the projections on the second stabilizer extending into the round hole in the rail to form a laterally and longitudinally positionally stabilized second stabilizer, (f) fastening the positioned second stabilizer to the rail to form a fastened second stabilizer, (g) axially inserting the baluster into the transverse primary opening through the first stabilizer, (h) axially inserting the baluster into the transverse primary opening through the second stabilizer, (i) axially inserting the proximal end of the baluster into the round hole extending into the floor, and (j) axially inserting the distal end of the baluster into the round hole extending into the rail.

10. The method of claim 9 wherein step (a) is performed before step (g), step (b) is performed before step (c), and steps (c) through (j) are performed in the ordered sequence (c), (d) (g), (i), (h), (j), (e) and (f).

11. The method of claim 9 further comprising the steps of:

(k) obtaining a pair of baluster shoes, (l) axially sliding the pair of baluster shoes onto the baluster before completing both steps (g) and (h), (m) axially sliding one of the baluster shoes along the baluster into position to conceal the fastened first stabilizer, and (n) axially sliding the other baluster shoe along the baluster into position to conceal the fastened second stabilizer.

* * * * *